US005362045A

United States Patent [19]

Hammett et al.

[11] Patent Number: 5,362,045

[45] Date of Patent: Nov. 8, 1994

[54] PRACTICE DEVICE FOR THE GAME OF HOCKEY

[75] Inventors: Brad Hammett; Joseph C. Morin, both of Edmonton, Canada

[73] Assignee: 7th Man Enterprises Inc., Edmonton, Canada

[21] Appl. No.: 121,348

[22] Filed: Sep. 15, 1993

[51] Int. Cl.[5] ..... A63B 69/00

[52] U.S. Cl. ..... 273/57.2; 273/127 C; 273/396

[58] Field of Search ..... 273/57.2, 127 C, 396, 273/397

[56] References Cited

U.S. PATENT DOCUMENTS

| | | | |
|---|---|---|---|
| 3,194,556 | 7/1965 | Vinson | 273/26 |
| 3,204,966 | 9/1965 | Saytar | 273/127 |
| 3,529,825 | 9/1970 | White, Sr. | 273/67 |
| 3,706,451 | 12/1972 | Dixon | 273/26 A |
| 3,709,489 | 1/1973 | Holleran | 273/57.2 |
| 3,834,697 | 9/1974 | McNamarra et al. | 273/57.2 |
| 3,840,228 | 10/1974 | Greaney | 273/57.2 |
| 3,863,917 | 2/1975 | Beale | 273/57.2 |
| 4,023,797 | 5/1977 | Sarrasin | 273/57.2 |
| 4,111,419 | 9/1978 | Pellegrino | 273/57.2 |
| 4,343,468 | 8/1982 | Lindgren | 273/67 A |
| 4,478,420 | 10/1984 | Sowards | 273/397 X |
| 4,491,320 | 1/1985 | Smith | 273/57.2 |
| 4,516,769 | 5/1985 | Kopp | 273/57.2 |
| 5,161,799 | 11/1992 | Nandra | 273/57.2 |

FOREIGN PATENT DOCUMENTS

| | | | |
|---|---|---|---|
| 125803 | 5/1910 | Canada . | |
| 850516 | 9/1970 | Canada | 273/54 |
| 967606 | 5/1975 | Canada | 273/44 |

*Primary Examiner*—William H. Grieb
*Attorney, Agent, or Firm*—Anthony R. Lambert

[57] ABSTRACT

A practice device for the game of Hockey consisting of a body having at least two support members. The body is secured to an ice surface, such that the two support members are immediately adjacent the ice surface. A resilient rebound member extends between the two support members, such that the rebound member springs back with a resilient force when struck by a hockey puck thereby increasing the resulting rebound of the hockey puck.

16 Claims, 16 Drawing Sheets

PRACTICE DEVICE FOR THE GAME OF HOCKEY

The present invention relates to a practice device for the of Hockey.

BACKGROUND OF THE INVENTION

During the last decade, the game of Hockey has changed dramatically. Players are bigger, stronger, faster and more skilled than ever before. Skills training has become an essential component in obtaining and maintaining successful careers. Players must focus upon the basic skills of skating, passing and shooting the puck. Improvements in the these skills are only acquired through repetitious drills.

A player can practice skating and shooting the puck in isolation. It is virtually impossible for a player to practice receiving a pass without the participation of other players. There is a need for a suitable and practical device for practicing his puck passing and receiving skills. The device should reasonably accurately duplicate the characteristics of a pass received from another player. The device should also provide the player a relatively large number of passes in a reasonable time period so that a concentrated, realistic and beneficial practice can be experienced, without the necessity of additional personnel being required.

SUMMARY OF THE INVENTION

What is required is a practice device for the game of Hockey which assists in the development of puck passing and receiving skills.

According to the present invention there is provided a practice device for the game of Hockey which is comprised of a body having at least two support members. Means is provided for securing the body to an ice surface, such that the at least two support members are immediately adjacent the ice surface. A resilient rebound member extends between the at least two support members. The rebound member springs back with a resilient force when struck by a hockey puck thereby increasing the resulting rebound of the hockey puck.

Although the rebound member can take a number of alternate forms, in order to avoid the necessity of using springs and the like it is preferred that the rebound member be an elongate elastic band placed in tension between the support members.

The device is secured to an ice surface, preferably by a set of pins which penetrate the ice. When a player shoots a puck at the band the elasticity of the band provides an enhanced rebound which varies depending on the angle and velocity at which the puck strikes the band. By practicing shooting the puck at the band at different velocities and from different angles, the player can improve his skills in passing the puck and receiving it back on his stick. The device is designed for repetitive practice by a single player or a group. There are many variations of practice drills applicable with the device as will hereinafter be further described. Various other drills may be devised for player rehabilitation and fitness development, depending on the individual player's program.

Although beneficial results may be obtained through the use of the invention as described, even more beneficial results may be obtained when the body has three support members in a triangular configuration. It is preferred that the spacing between the support members define an equilateral triangle.

When a triangular configuration is used, the puck can be shot toward any of the three sides of the body. When an equilateral triangular configuration is used a continuous band can be used while still keeping the rebound responsiveness the same from each of the three sides.

Although beneficial results may be obtained through the use of the device as described, even more beneficial results may be obtained when means is provided to alter the relative spacing between the support members, thereby altering the tension on the band.

This permits the tension in the band to be adjusted to suit the practice requirements of the player or team. Through prolonged use the band will inevitably stretch. With the device as described the relative spacing of the support members can be periodically adjusted to maintain constant tension even after prolonged use. The preferred means for adjusting the relative spacing of the support members is a mechanism analogous to a cam arrangement in which at least two push rod guides are secured to the body. At least two push rods are received in the push rod guides and axially movable in relative to the push rod guides between extended and retracted positions. Each of the supports is attached to one of the push rods, such that as the push rods move axially between the extended and retracted positions the relative spacing of the supports is altered. A guide track is secured to the body. A movable member is slidably secured to the guide track. The movable member being in communication with the push rods. Upon movement of the movable member in one direction the push rods are axially extended in relation to the push rod guides. Upon movement of the movable member in a second direction the push rods are axially retracted in relation to the push rod guides. Means is provided for moving the movable member.

Although beneficial results can be obtained through the use of the device as described, problems can on occasion be experienced with the force of the hockey puck twisting the band, resulting in the hockey puck passing under the band. Even more beneficial results may, therefore, be obtained when the band is of a cross-section which resists longitudinal torsion. It is preferred that the band having an upper edge, a lower edge, and being inwardly tapered from the upper edge and the lower edge.

The flexible band is extruded from a polymeric material selected for optimum physical parameters of cold resistance, flexibility at low temperatures, weather resistance, resistance to chemicals, dimensional stability, elongation range and resistance to compression set. It is preferred that the band be made from a thermoplastic material or thermosetting plastic material which is resistant to impact and low temperatures.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
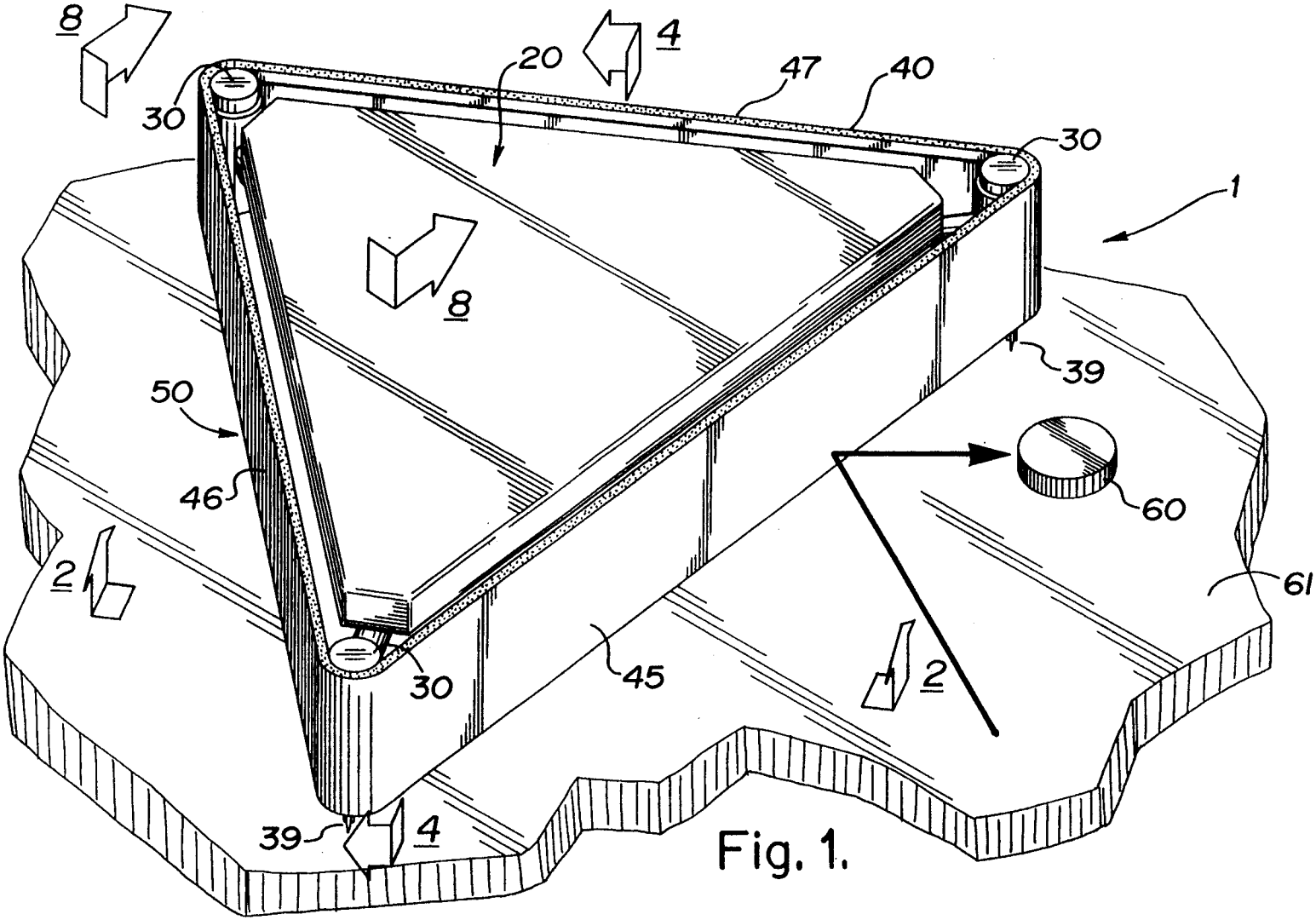
FIG. 1 is a perspective view showing a practice device for the game of Hockey constructed in accordance with the teachings of the present invention.

The preferred embodiment, a practice device for the game of Hockey generally identified by reference numeral 1, will now be described with reference to FIGS. 1 through 23.

In its most elementary form device 1 consists of a body 20 having at least two support members 30. It is preferred that pins 39 be used as means for securing body 20 to an ice surface 61. When secured to an ice surface 61 the support members 30 are immediately adjacent the ice surface 61. Support members 30 serve to support an elongate elastic band 40. Band 40 is placed in tension between support members 30, such that the elasticity of band 40 increases the resulting rebound when a hockey puck 60 strikes band 40 to simulate a return pass. The preferred embodiment which will be hereinafter described uses three support members 30 arranged in an equilateral triangular configuration. The form of band 40 which is used is continuous. Means is provided to alter the relative spacing between the support members 30, thereby altering the tension on the continuous band 40.

Figure 2:
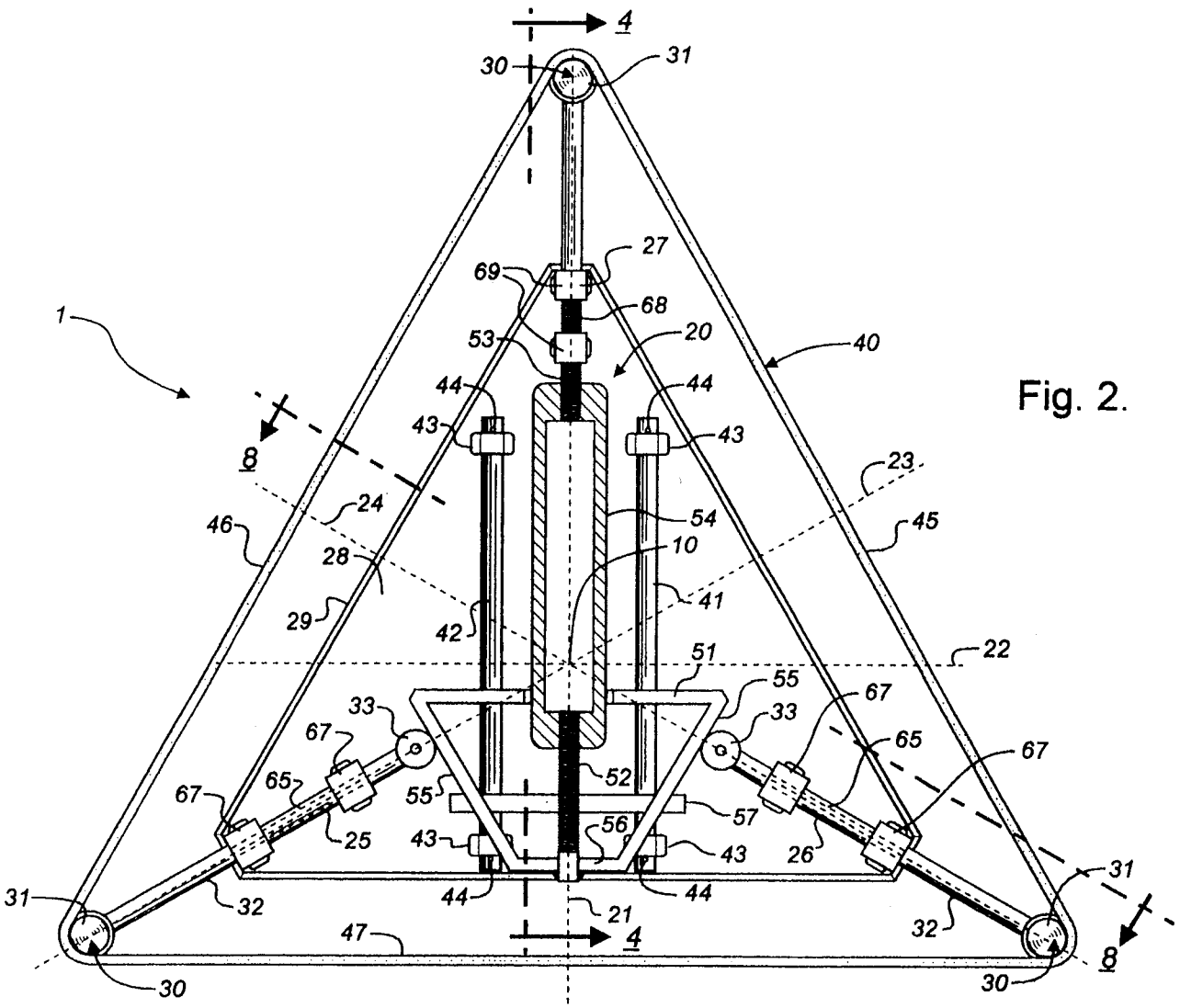
FIG. 2 is a underside section view taken along section lines 2—2 of FIG. 1, with the band to its maximum elongation.
Figure 3:
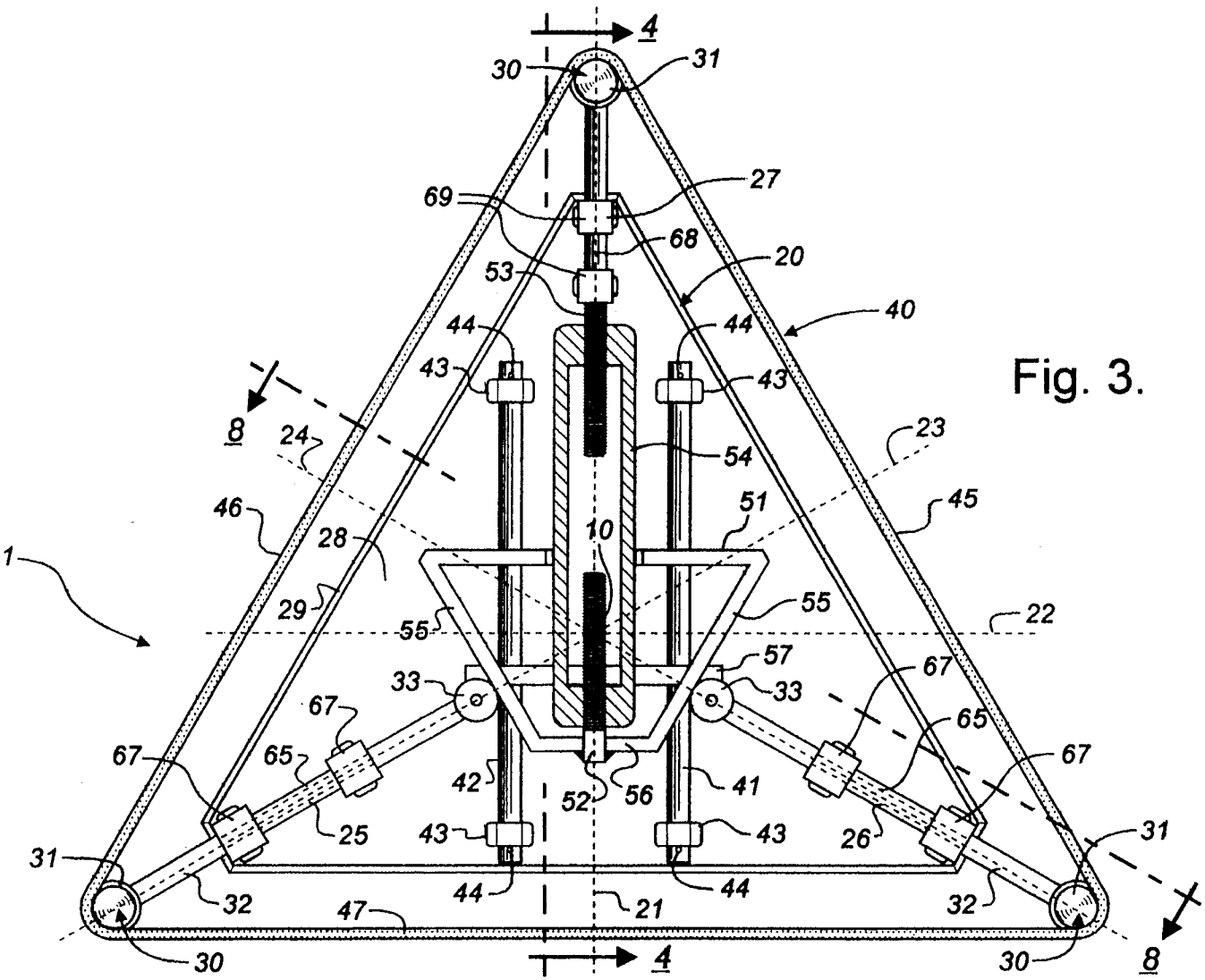
FIG. 3 is an underside section view taken along section lines 2—2 of FIG. 1, with the band relaxed to its minimum elongation.

Referring now more particularly to FIGS. 1, 2 and 3 of the drawings, the device 1 consists of an equilateral triangular configured body 20 preferably fabricated from metal, with each side equal in length, defined by corner post support assemblies 30 located axially 120 degrees apart, surrounded by a rebound members in the form of a flexible polymeric band 40 adjustable stretched equally on all three sides 45, 46 and 47 preferably by a flexible band tension adjustment effected through a movable member (51, 52, 55, 56) which is part of cam mechanism 50 (underneath the mounting plate assembly 20), that may be selectively adjusted from a single point 10 to provide a user selected rebound rate for a hockey puck 60 passed to strike any of the exterior vertical faces of the three sides 45, 46 and 46 of the flexible polymeric band 40 from any number of angles.

Device 1 provides an equal rebound rate from any one of the exterior vertical faces of the three sides 45, 46 and 47 of the flexible polymeric band 40 irregardless of which side is struck by the puck. Each side 45, 46 and 47 of the flexible polymeric band 40 thus is equal in length and the flexible polymeric band 40 has the same tension on each side as a result of equal stretch elongation of each side 45, 46 and 47 as achieved by the single point 10 axial adjustment position of the cam mechanism 50 eliminating unequal geometry of the corner posts assemblies 30 positions relative one to another and surrounded by the tension equalized flexible polymeric band 40.

FIG. 2 illustrates the underside of the device 1 and shows the mounting plate assembly 20 and the flexible polymeric band 40 stretched to its maximum length between perimeter corner post assemblies 30 as a result of the maximum linear adjustment of the cam mechanism 50 shown in advanced extension axially through the push rod guide 27 along the reference centerline 21 to the maximum limits of the parallel metal cam guide rods 41 and 42 and as established by screw threads 52 and 53 maximum positional separation along the axial centerline 21 as determined by the counterclockwise rotation of the adjusting turnbuckle 54.

FIG. 3 illustrates the underside of the device 1 and shows the mounting plate assembly 20 and the flexible polymeric band 40 relaxed to its minimum length between perimeter corner post assemblies 30 as a result of the minimum linear adjustment of the cam mechanism 50 shown in retracted position axially through the push rode guide 27 along the reference centerline 21 to the minimum limits of the parallel metal cam guide rods 41 and 41 and the restrictive clearance between the ends of screw threads 52 and 53 controlled along the axial centerline 21 by the clockwise rotation of the adjusting turnbuckle 54.

The mounting base assembly 20 is preferably fabricated of heavy gauge sheet metal plate 28 and rectangular section metal flat bar stock and generally of sufficient thickness to weld or otherwise fasten component parts to the base plate 28 without distortion, warping or bending as stiffness of the assembly is preferable for precise function of the device and geometric positioning of component parts. The overall weight of the assembly is preferably in the range of 12 Lbs (5.5 Kg) to 20 Lbs (9 Kg) in order to ensure minimal, and preferably no movement of the device 1 when placed on the ice surface 61 and repeatably impacted by hockey pucks 60 passed to it as the device 1 is utilized.

Underside plan views FIGS. 2 and 3 and sectional views of FIGS. 4 to 9 show various details of the base assembly 20 in an equilateral triangular metal plate 28 1/16" (1.5 mm) to ¼" (6 mm) thickness with dimensions of 18" (7 cm) along each long side edge.

The plate 28 along side edges are symmetrically disposed one to another with an included angle of 60 degrees and aligned at a 30 degree angle either side of bisecting centerlines 21, 23 and 24 with a reference center point 22 where all centerlines intersect as shown on the FIGS. 2 and 3. At each apex of the triangle, the plate 28 long edges are cut-off to form a short edge 1" (2.5 cm) wide at a 90 degree angle to the bisecting centerlines 21, 22 and 23 and are equally spaced either side thereof.

The base plate 28 has flanges 29 formed at right angles to the underside horizontal face of the plate 28 extending downward on all perimeter edges of the plate 28 a preferable distance of 1" (2.5 cm). These flanges 29 may alternately be fabricated of rectangular section metal flat band and attached as by welding to each edge of the plate 28 at the 90 degree angle desired.

Figure 4:
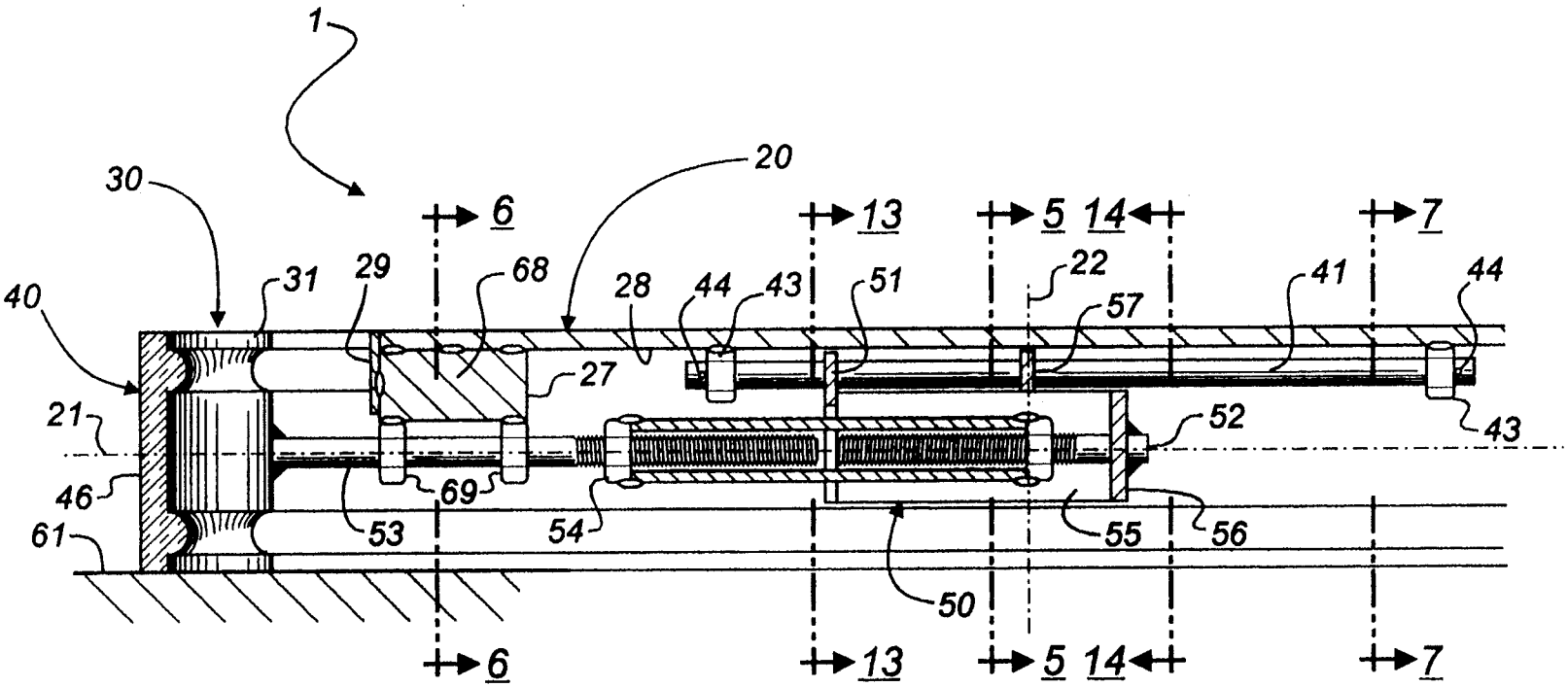
FIG. 4 is a centerline sectional side view taken along section lines 4—4 of FIGS. 1, 2 and 3.
Figure 5:
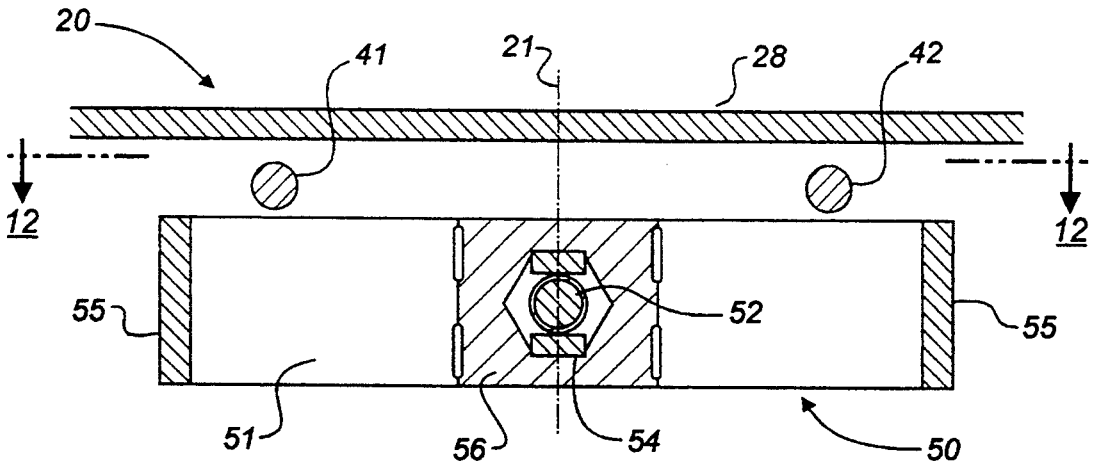
FIG. 5 is a cross sectional end view taken along section lines 5—5 of FIG. 4.
Figure 6:
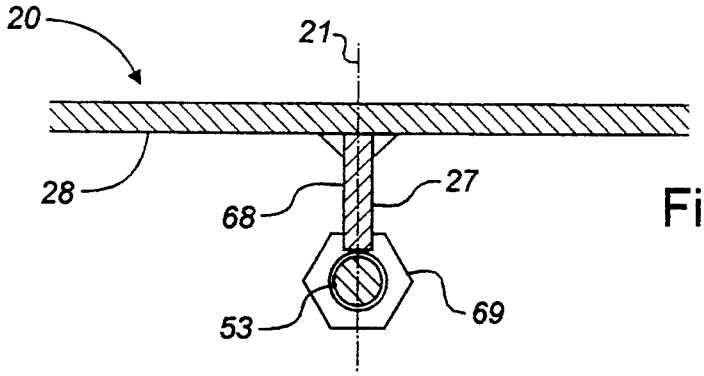
FIG. 6 is a cross sectional end view taken along section lines 6—6 of FIG. 4.
Figure 7:
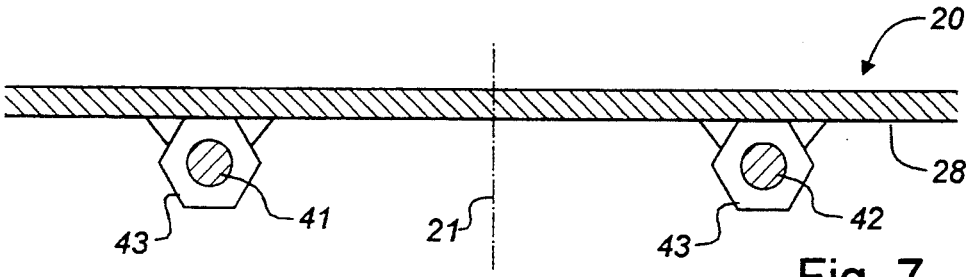
FIG. 7 is a cross sectional end view taken along section lines 7—7 of FIG. 4.
Figure 8:
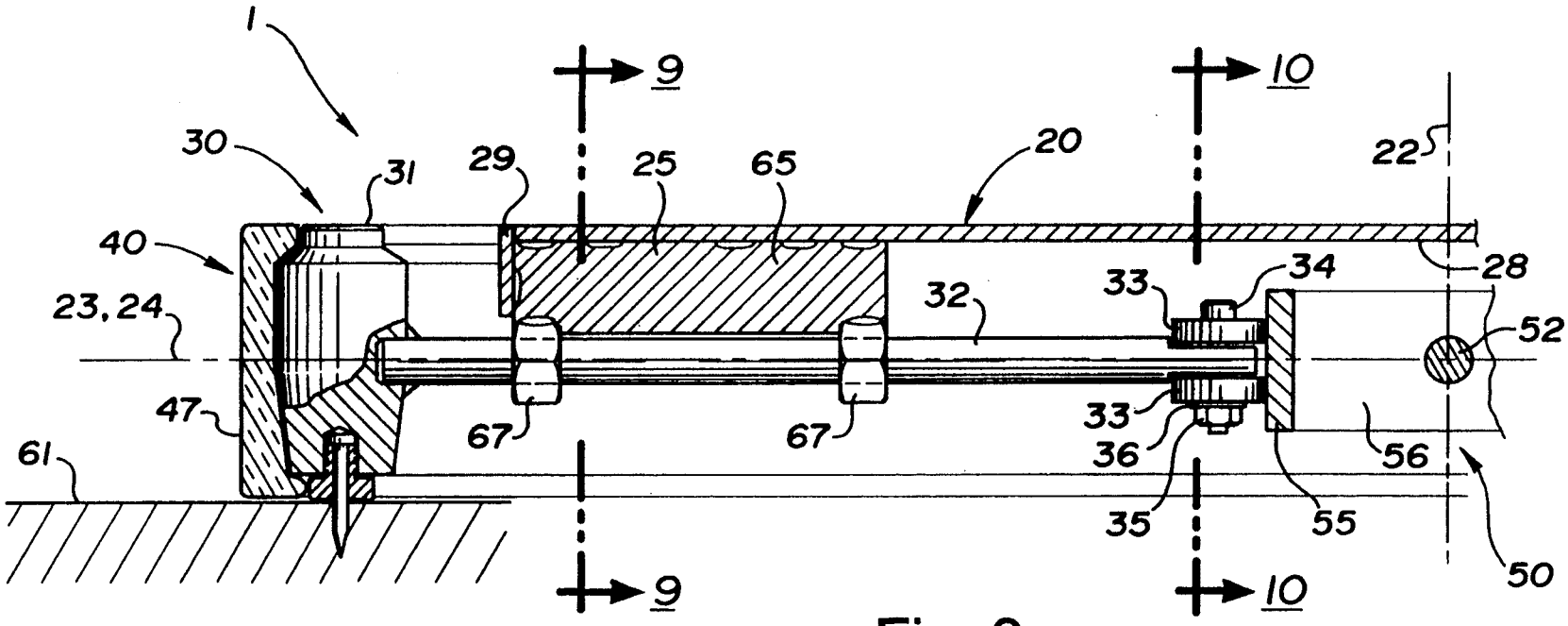
FIG. 8 is an enlarged cross sectional side view taken along section lines 8—8 of FIGS. 1, 2 and 3.
Figure 9:
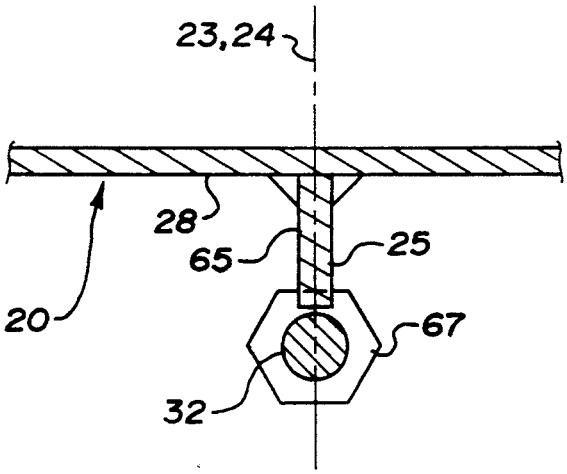
FIG. 9 is a cross sectional end view taken along section lines 9—9 of FIG. 8.

Attached as by welding to the underside of the base plate 28 are various appurtenances as shown in the Figures and details of FIGS. 2 to 9 and described hereinafter. Push rod guides 25 and 26 are identical and each are fabricated from a rectangular section metal spacer bar 65 4" (10 cm) long and two spaced cylindrical metal bushings 67 welded thereto centered and flush to each end of the spacer bar 65 with the bushing bores axially inline and of such a diameter so as to allow the guide push rods 32 to pass through the bushings 67 and reciprocate linearly and freely with minimum friction and limited side play tolerances. The sub-assemblies 25 and 26 comprised of the bushings 67 and spacer bar 65 are attached as by welding to the underside of the base plate 28 flush to the end cut-off apexes of the plate 28 on the axial centerlines 23 and 24 with the side of the spacer bar 65 aligned vertically at a 90 degree right angle to the base plate 28 undersurface. The bore holes of bushings 67 of the push rods guides 25 and 26 are aligned horizontally and parallel to the undersurface of the base plate 28. FIG. 8 shows a side elevation view, partially cutaway, of these assemblies and FIG. 9 shows a vertical cross section view through the push rod guide assemblies. The push rod guides 25 and 26 vertical height is such that when the push rod 32 horizontal centerline is projected towards the center of the device it intersects the horizontal centerline of the cam mechanism 50 at the preferred distance of 1.5" (3.8 cm) below the underside face of the base plate 28. The shorter push rod guide 27 shown in FIG. 4 is 2" (5 cm) long and is fabricated and positioned similarly as the rod guides 25 and 26 except that it is located on the centerline 21 with the threaded end push rod 53 passing through the guide 27 as shown in FIGS. 2, 3, 4 and 6. Guide 27 has a spacer bar 68 which is similar to spacer bar 65 and a bushing 69 similar to bushing 67. Bushing 69 receives rod 53.

The flexible band tension adjustment cam mechanism 50 is guided linearly along the centerline 21 by a pair of round metal bar cam guide rods 41 and 41 that are each positioned parallel to and equi-distant from the centerline 21 by four metal mounting lugs 43 welded to the underside of the base plate 28. The lugs 43 have horizontal bore holes through and cam guide rods 41 and 42 are aligned horizontally and parallel to the undersurface of the base plate 28.

The lugs 43 hole bores are axially inline and of such a diameter so as to allow the cam guide rods 41 and 42 to pass through linearly freely with slight friction and close tolerance fit. The cam guide rods 41 and 42 are retained in position with cotter keys 44 inserted through a hole in each end of the rods and the keys are spread apart to lock the guide rolls in place. FIG. 4 shows a side elevation view, partially cutaway, of these assemblies and FIG. 7 shows a cross section view through the mounting lugs 43 and cam guide rods 41, 42.

The base assembly 20 is shown on the drawings as fabricated component weldments but it may be obvious to the practitioner of metal trades that many of the individual components may be either stamped from sheet metal, cast as monololithic sub-assemblies or injection-moulded from reinforced, high impact rigid polymers such as glass-filled polycarbonate or other high strength polymeric compounds or structural composites materials.

As shown in FIG. 4 (perimeter corner post assembly 30 shown in retracted minimum position), one corner post assembly 30 is comprised of a cylindrical, vertically positioned metal bar 31 attached as by welding to an axially guided right hand threaded metal push rod 53. The assembly 30 is free to move axially along the device centerline 21 located at a 120 degree angle radially from each of the centerlines 23 and 24 and perpendicular at a 90 degree angle to the end side plate 51 of the cam assembly 50 with axial alignment controlled by the position of rod guide assembly 27 and the relative linear position of the cam assembly 50 as determined by the clockwise rotation of the adjusting turnbuckle 56 shown in maximum engagement of the opposing push rod 53 and the left hand threaded metal cam push rod 52.

FIG. 8 (assembly 30 shown in retracted minimum position) shows the details of the other two perimeter adjacent corner post assemblies 30 which are comprised of a cylindrical, vertically positioned metal bar 31 attached as by welding to axially guided identical metal push rods 32 each of which are fitted as by bolting with a pair of opposite end horizontally mounted metal rollers 33. These assemblies 30 are free to move axially along a path established by the device centerlines 23 and 24 located at 120 degrees angle apart and the push rods 32 axial alignment controlled by the positions of rod guide assemblies 25 and 26. The rollers 33 bear perpendicularly at 90 degrees against the face of the angled cam side plates 55 of the assembly 50 with contact maintained against the cam sides 55 by the inwardly acting tension of the flexible polymeric band assembly 40. Push rod rollers 33 are spaced apart vertically on either side of the top and bottom relieved faces 66 of the push rods 32 to provide a maximum bearing area against the cam side plates 55 to resist the torsional effect of the rod 32 mounted band support post 31 and maintain the longitudinal axis of the cylindrical band support posts 31 plumb in a vertical position.

Figure 10:
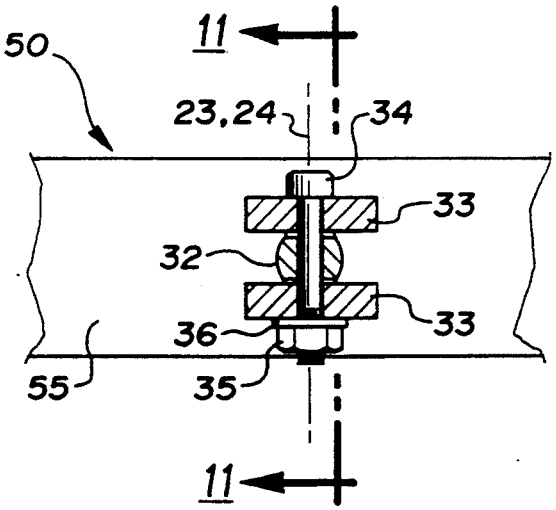
FIG. 10 is a cross sectional view taken along section lines 10—10 of FIG. 8.
Figure 11:
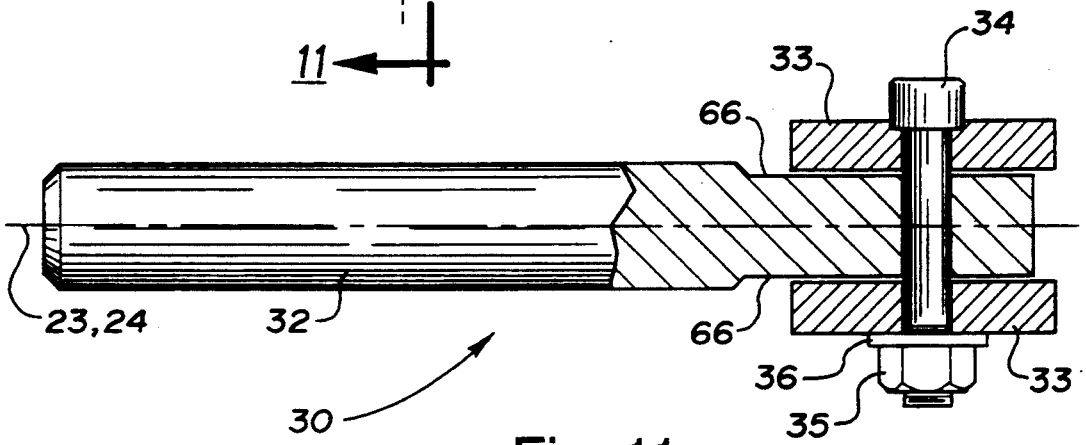
FIG. 11 is an enlarged cross sectional side view, partially cutaway, taken along section lines 11—11 of FIG. 10.

The rollers 33 are preferably fastened to the push rods 32 with a vertical disposed through metal socket headed cap screw 34 centrally located in minimal clearance holes through the roles 33 and push rods 32 as shown in FIGS. 8, 10 and 11. The bolt 34 is secured by a nut 35 and a shakeproof lock washer 36. The nut 35 is tightened only, to the extent that the rollers 33 are free to rotate in a horizontal plane without binding upon the relieved faces 66 of the push rods 32. The projecting exposed thread of the screw 34 is punch-pricked to prevent the nut 35 from loosening off from its optimum assembly position.

Figure 12:
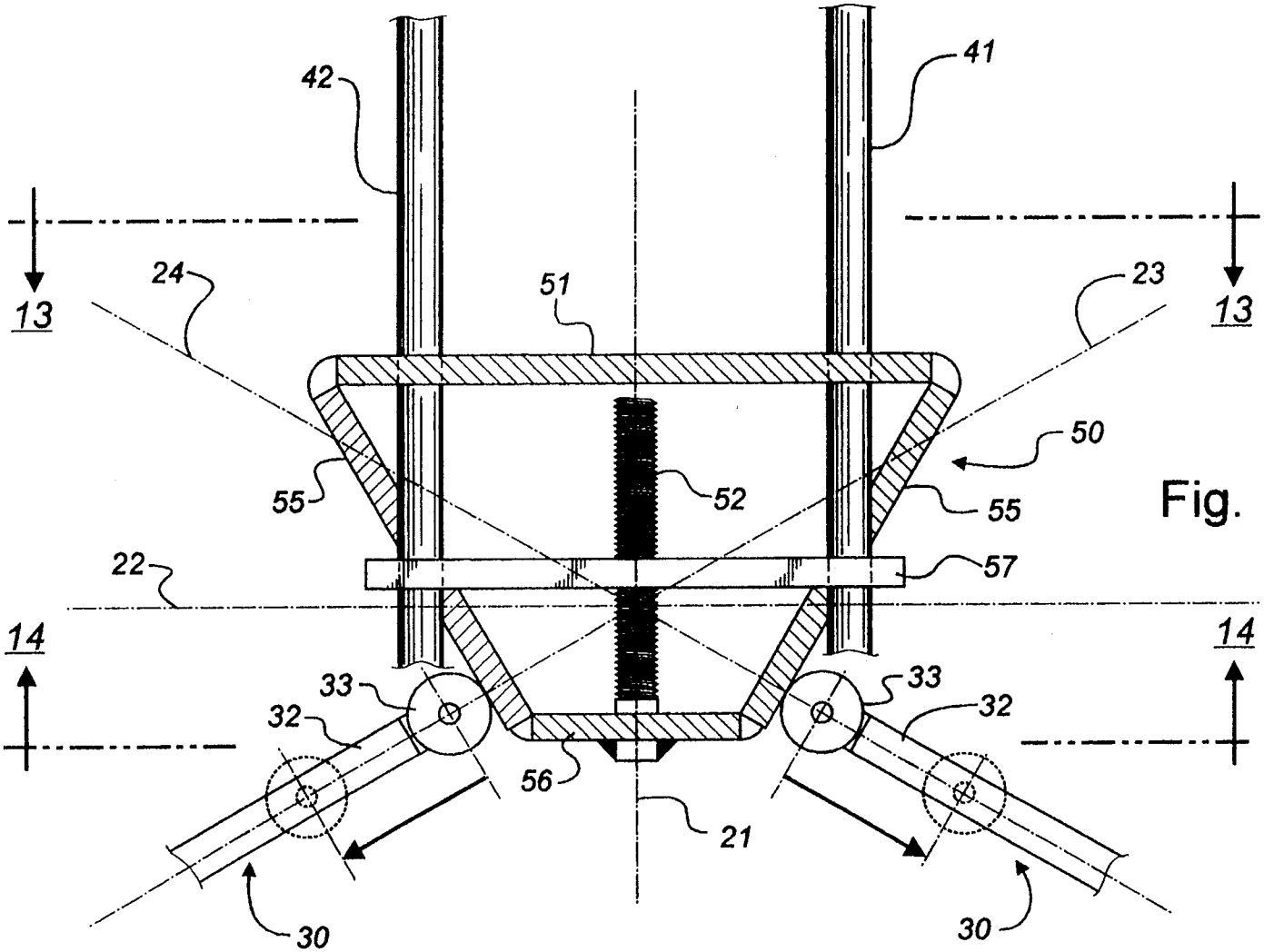
FIG. 12 is an enlarged cross sectional top plan view taken along section lines 12—12 of FIGS. 4, 5 and 8.

FIG. 12 shows in an enlarged top plan cutaway view the retracted (minimum) positional relationships of the flexible band tension adjustment cam assembly 50 to the push rods 32 of the band support post assemblies 30. The cam assembly 50 preferably is comprised of a plurality of metal components assembled as by welding into an equilateral triangular configuration with the metal side plates 51, 55 and 56 being equal in length and of rectangular cross section.

Figure 13:
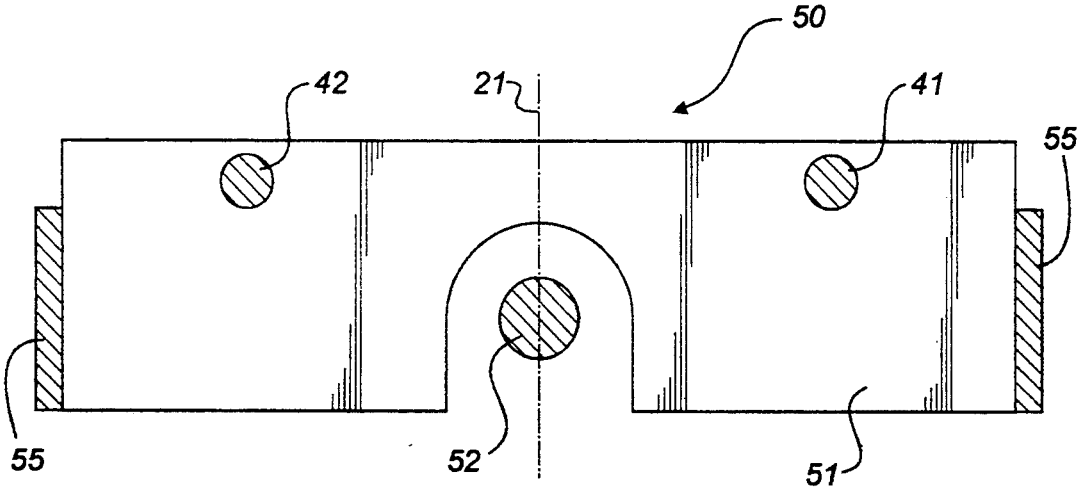
FIG. 13 is an enlarged cross sectional view taken along section lines 13—13 of FIGS. 4 and 12.

The end plate 51 is a rectangular cross section metal plate horizontally and vertically predisposed at 90 degrees to the bisecting centerline 21 of the device 1 as shown in FIG. 12 and the cross sectional end view FIG. 13 taken generally along the line 13—13 of FIG. 12. The plate 51 has two holes spaced parallel to and equi-distance from the longitudinal centerline 21 to receive the two cylindrical metal cam guide rods 41 and 42. On the centerline 21, the bottom edge of plate 51 is cutout symmetrically about the centerline 21 to provide clearance for the cam adjusting turnbuckle 54 and the rod 52.

Figure 14:
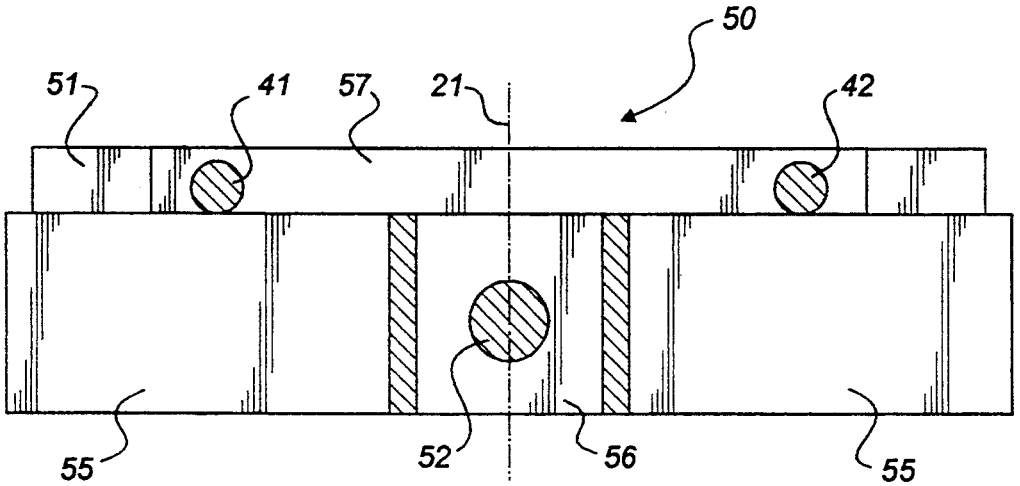
FIG. 14 is an enlarged cross sectional view taken along section lines 14—14 of FIGS. 4 and 12.

Two rectangular cross section metal side plates 55 vertically abut the end edges of the plate 51 at a horizontal included angle of 60 degrees and are symmetrically predisposed horizontally at 30 degrees either side of the bisecting centerline 21 of the device. One apex of the triangular assembly is truncated at 90 degrees to the centerline 21 and is terminated by the rectangular cross section metal end plate 56 as shown in FIG. 14 section taken generally on the line 14—14 of FIG. 12. Plate 56 is butted between side plates 55 and attached as by welding. End plate 56 has a centrally located hole on the longitudinal axial centerline 21 to receive a cylindrical metal left-hand threaded cam push rod 52 that is attached as by welding to the plate 56.

Bridging the two side plates 55 is a rectangular section metal guide bar 57 affixed to the top edges of the plates 55 at a 90 degree angle to the centerline 21 and attached as by welding as shown on the FIG. 14. The guide bar 57 has two holes spaced parallel to and equidistance from the longitudinal centerline 21 to receive the two cylindrical metal cam guide rods 41 and 42. These holes line up vertically and horizontally with the two holes of the end plate 51.

The cam mechanism 50 assembly is free to reciprocate linearly on the guide rods 41 and 42 along the axial centerline 21 with the guide rod rollers 33 engaged against the side plates 55 of the cam.

Figure 15:
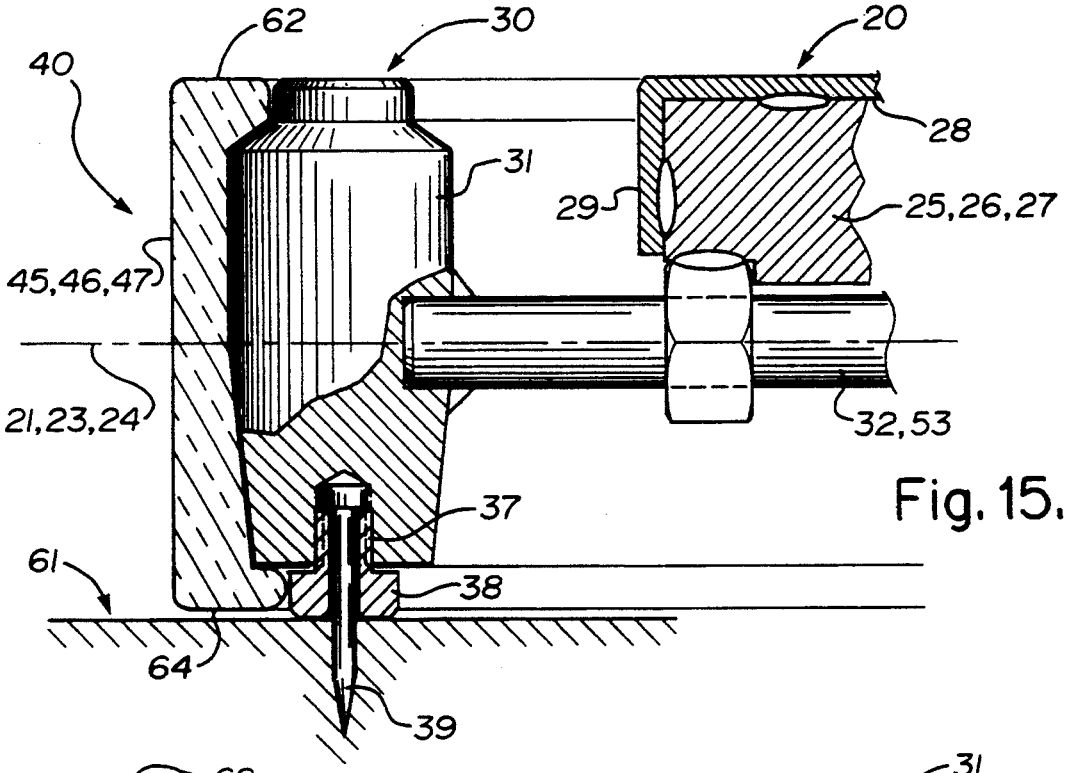
FIG. 15 is an enlarged cross sectional view of a portion of the practice device for the game of Hockey illustrated in FIGS. 4 and 8.

FIG. 15 is an enlarged elevation view, partially cutaway, of the flexible polymeric band 40 perimeter support post assemblies 30 taken generally on the lines 4—4 and 8—8 of FIGS. 2 and 3. The support post assembly 30 is comprised of a vertically disposed cylindrical metal member machined to a symmetrical profile that matches the inside face 48 of the flexible polymeric band 40. The uppermost end of the post 31 is diametrically relieved to receive the upper inside flange 62 projection of the band 40 and the lowermost half of the post 31 is tapered to match the sloping inside lower wall 49 of the band 40. The post 31 has a blind hole drilled into its sidewall perpendicular to the post 31 vertical axis on the horizontal centerline 21 of the push rod 32. The push rods 32 and 53 are fitted into this sidewall hole in their respective posts 31 and attached as by welding. The lower end of the posts 31 have a blind hold 37 drilled upwards on the vertical centerline axis of the post. The hole 37 is threaded to receive a threaded bolt 38 therein.

Figure 17:
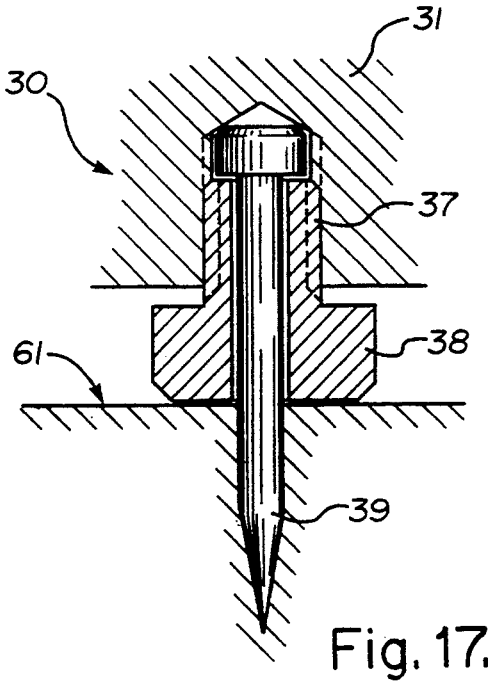
FIG. 17 is an enlarged cross sectional view of the lower end of the support showing the ice securing pin arrangement.

The enlarged elevation view, partially cutaway, FIG. 17 shows the device's ice securing pin arrangement. The depth of hole 37 is such that when a pin 39 inserted through the vertical hole of bolt 38 and the bolt 38 is screwed into the hole 37, the head of the pin 39 is longitudinally seated against the end of the hole 37 to secure the pin 39 in place before the bolt 38 is screwed fully into the hole 37. The pin 39 is preferably of a hardened metal and of such length as to extend through the bolt 38 and project a sufficient distance downward to engage the ice surface 61 upon which the device is played.

Figure 16:
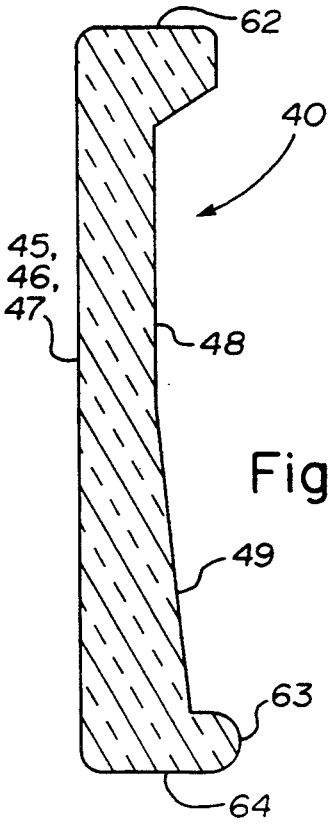
FIG. 16 is an enlarged cross sectional view of the band.

FIG. 16 is an enlarged cross sectional view through the flexible polymeric band 40. The section shows an outward facing side 47 and an inward facing side 48. The band 40 is preferably moulded or extruded in a constant cross section profile from a flexible polymeric thermoplastic material that has physical properties of resiliency at low temperatures, elongation stretchability, low compression set, chemical and environmental atmospheric resistances and is economically applicable to the device's objects. The preferable material has a hardness range of 60 to 80 Shore A durometer and is able to be thermofusion joined together to form a continuous band of sufficient length to circumvent the perimeter corner posts 30 of the device.

The band 40 has an upper edge flange 62 projecting inwardly to suit the relieved upper end of the post 31 to position the band vertically and prevent the band bottom edge 64 downward displacement from contacting the ice surface 61. The lower inside face 49 of the band 40 has a downwardly sloping wall thickening inwardly from the vertical center of the post 31 towards the lowest bottom diametrical edge of the post 31. The tapered thickness of the band 40 lower wall 49 provides resistance to the band's horizontal axis torsional forces and preferably the prevention of the hockey puck 60 from rotating the band inwardly upon impact of the puck and allowing the puck to pass under the band. The lower edge 64 of the band 40 has an inwardly projecting round-ended flange 63 that engages the bottom end surface of the post 31. The flange 63 prevents the band 40 from upwardly displacing in its engagement around the post 31. The band 40 preferably is generally equal in height to a normal hockey stick's blade and each face between perimeter corner posts 31 is generally of a length equal to the width of two hockey stick blades placed end to end. The band 40 of the device described herein is generally 3" (76 mm) high, has a midpoint thickness of 5/16" (8 mm) and a total assembled length of 62" (157 cm) but may be length sized proportionately as required for the device application and the particular tension desired and as adjusted by the band adjustment cam mechanism 50.

Figure 22:
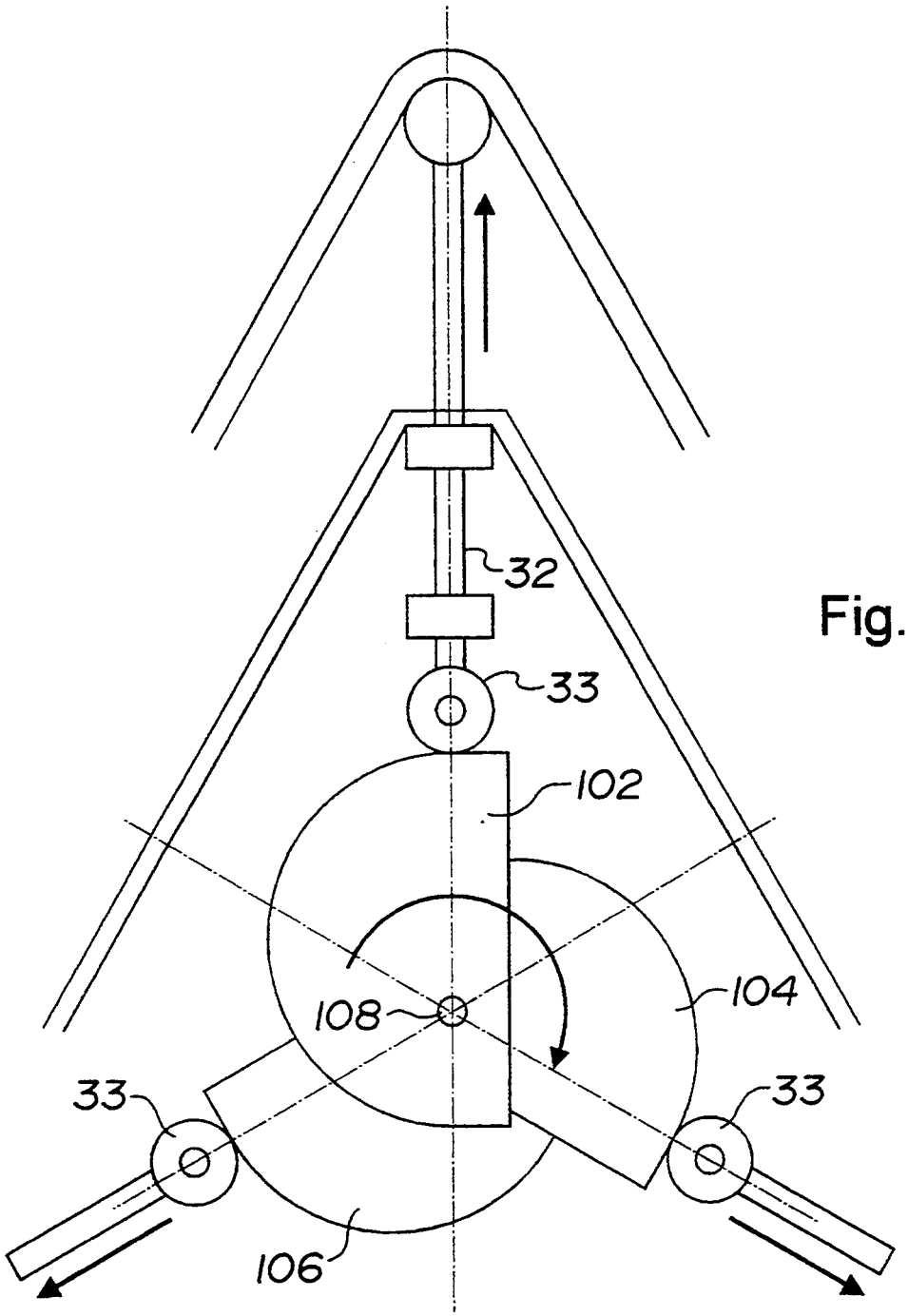
FIG. 22 is a bottom plan view of an alternate adjustment mechanism shown in an extended position.
Figure 23:
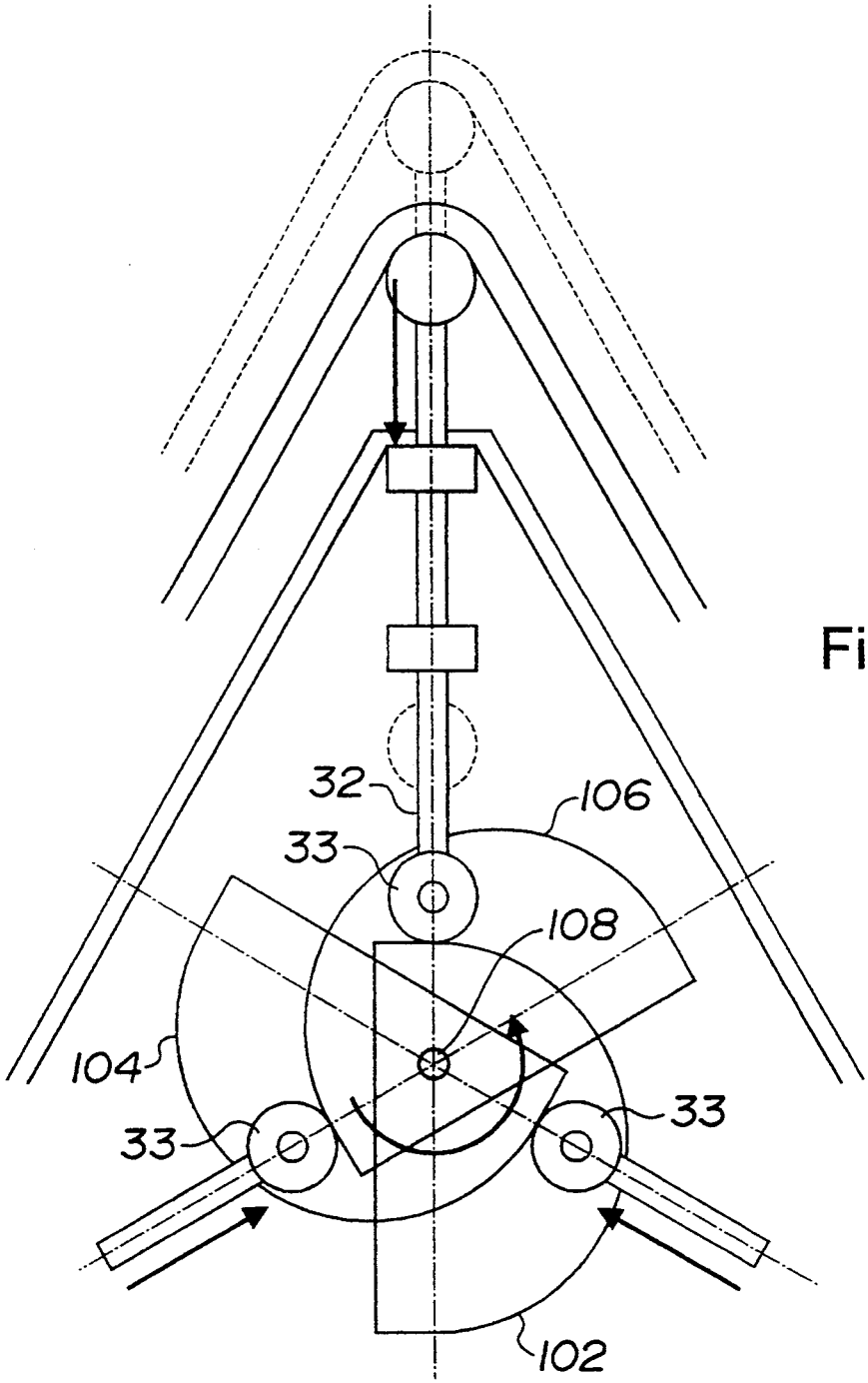
FIG. 23 is a bottom plan view of an alternate adjustment mechanism shown in a retracted position.

FIGS. 22 and 23 illustrate an alternate form of adjustment mechanism. Three cams 102, 104, and 106 are mounted on a common shaft 108. Rollers 33 from push rods 32 serve as followers and follow the contours of cams 102, 104 and 106 as shaft 108 is rotated. A crank (not shown) is used to manually adjust the positioning of shaft 108.

Figure 18:
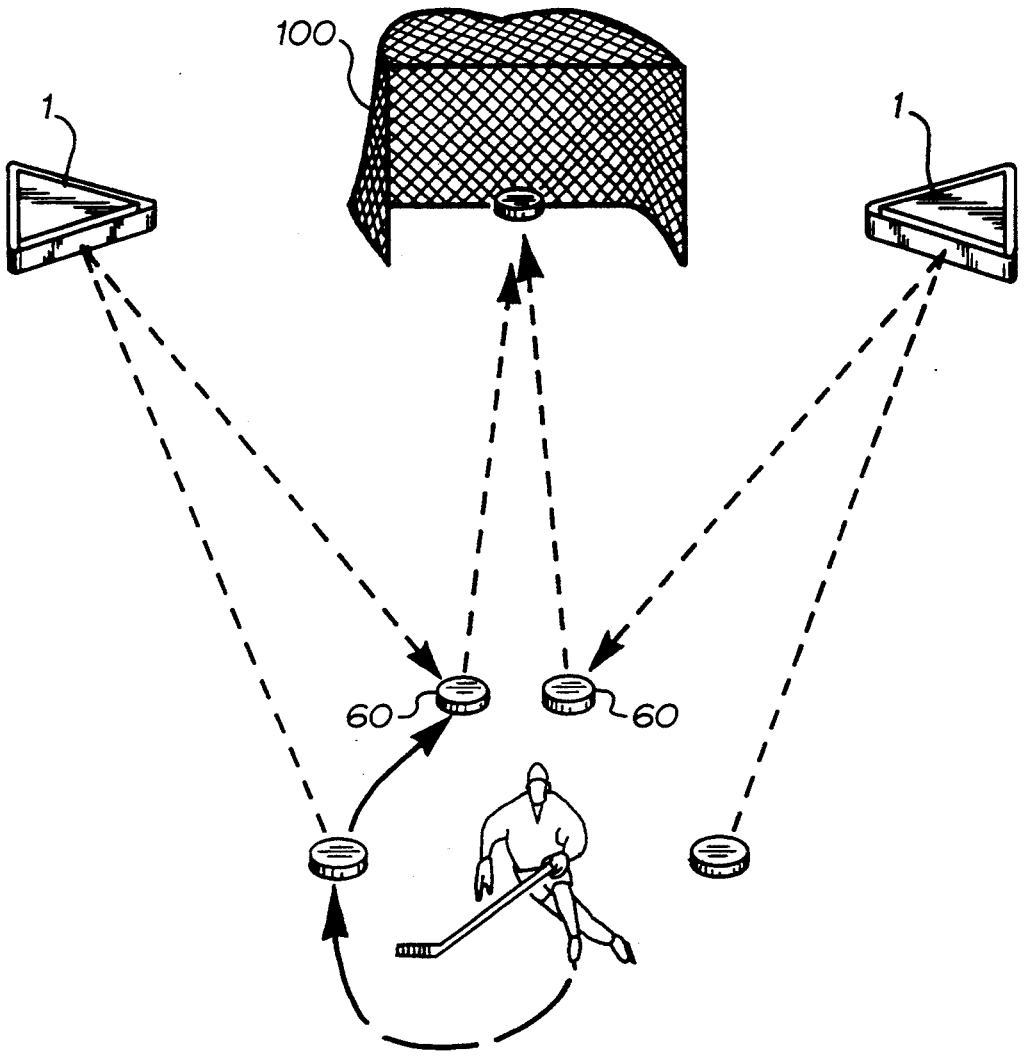
FIG. 18 is a diagrammatic representation of a first drill.
Figure 19:
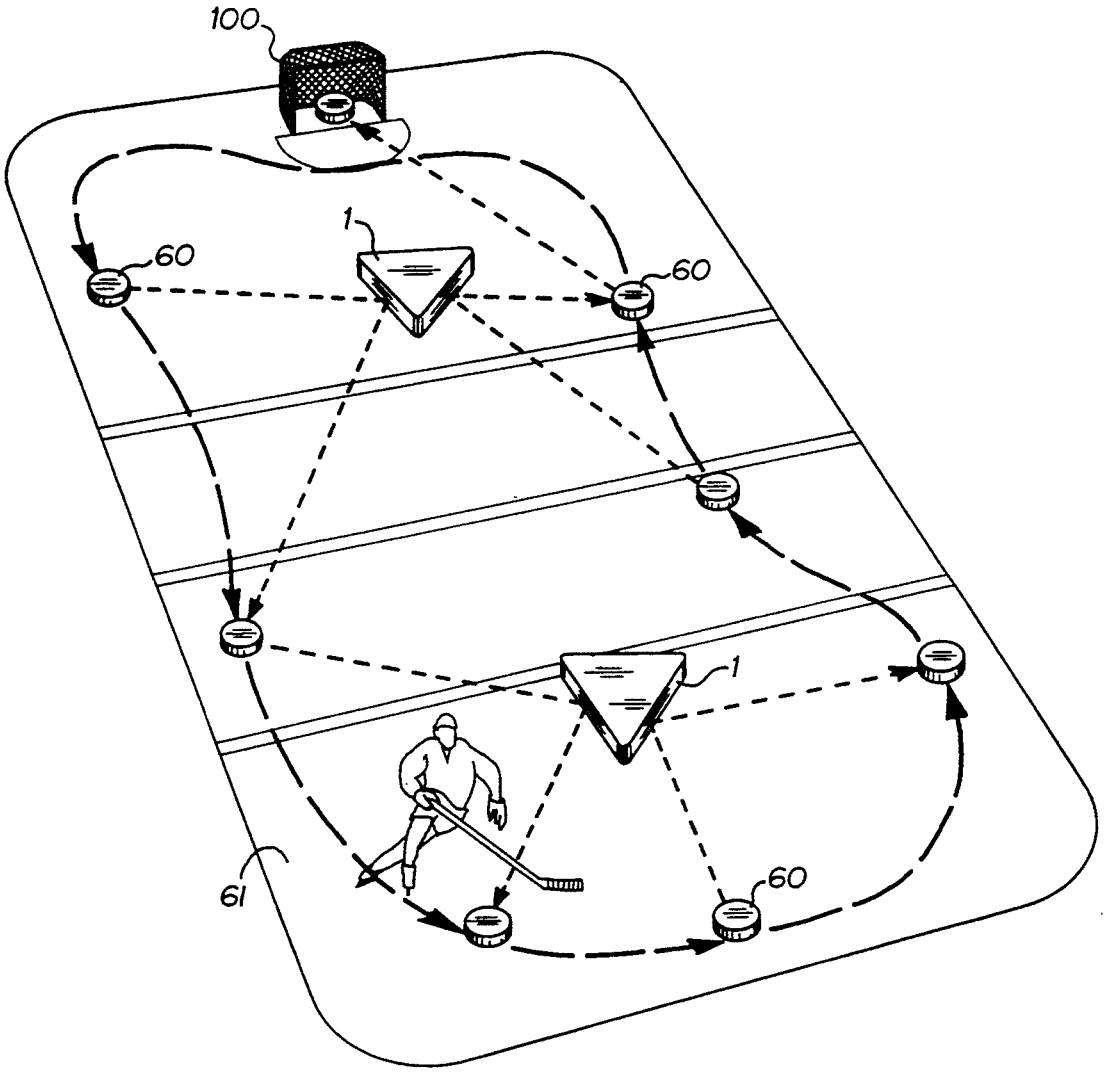
FIG. 19 is a diagrammatic representation of a second drill.
Figure 20:
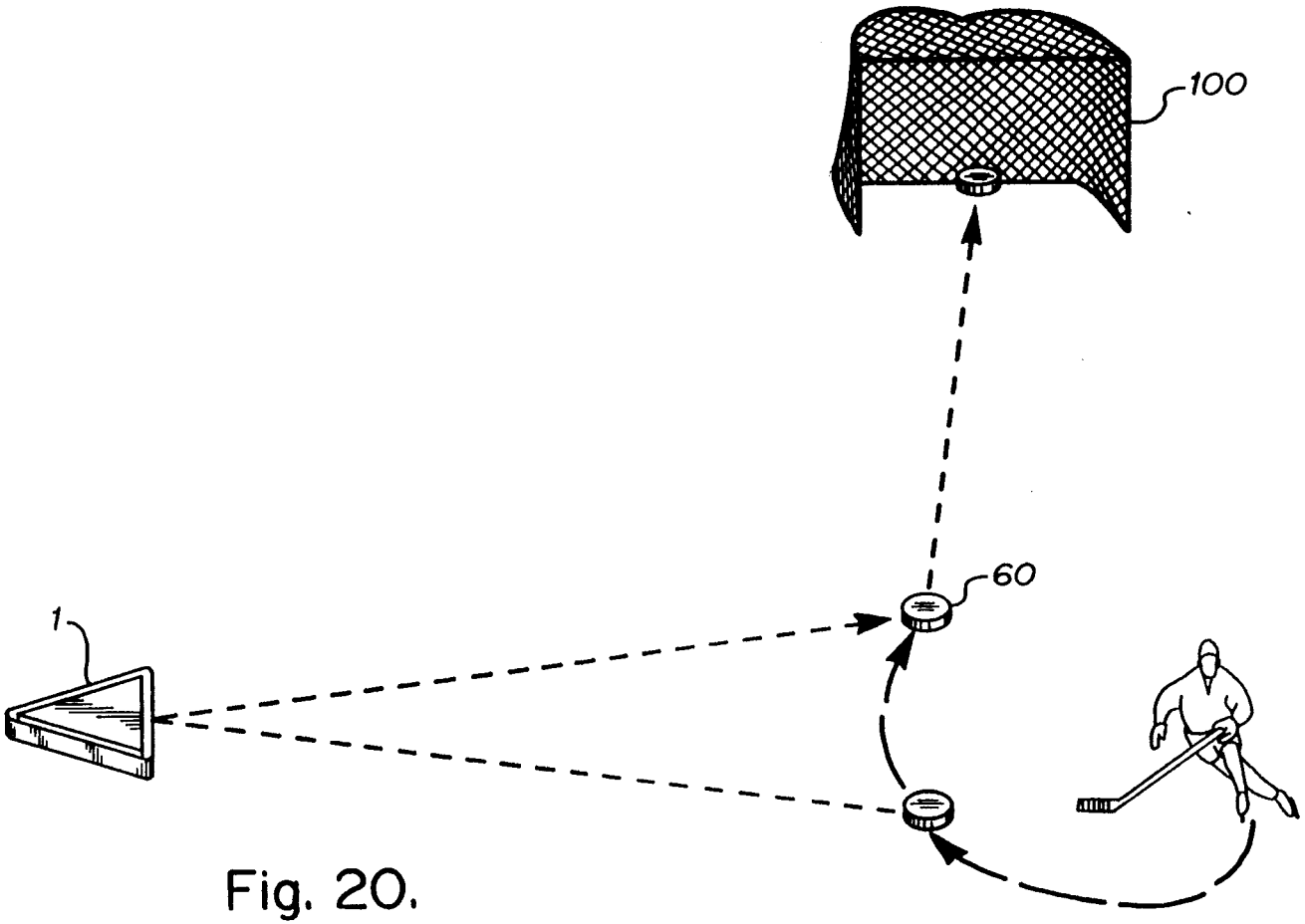
FIG. 20 is a diagrammatic representation of a third drill.
Figure 21:
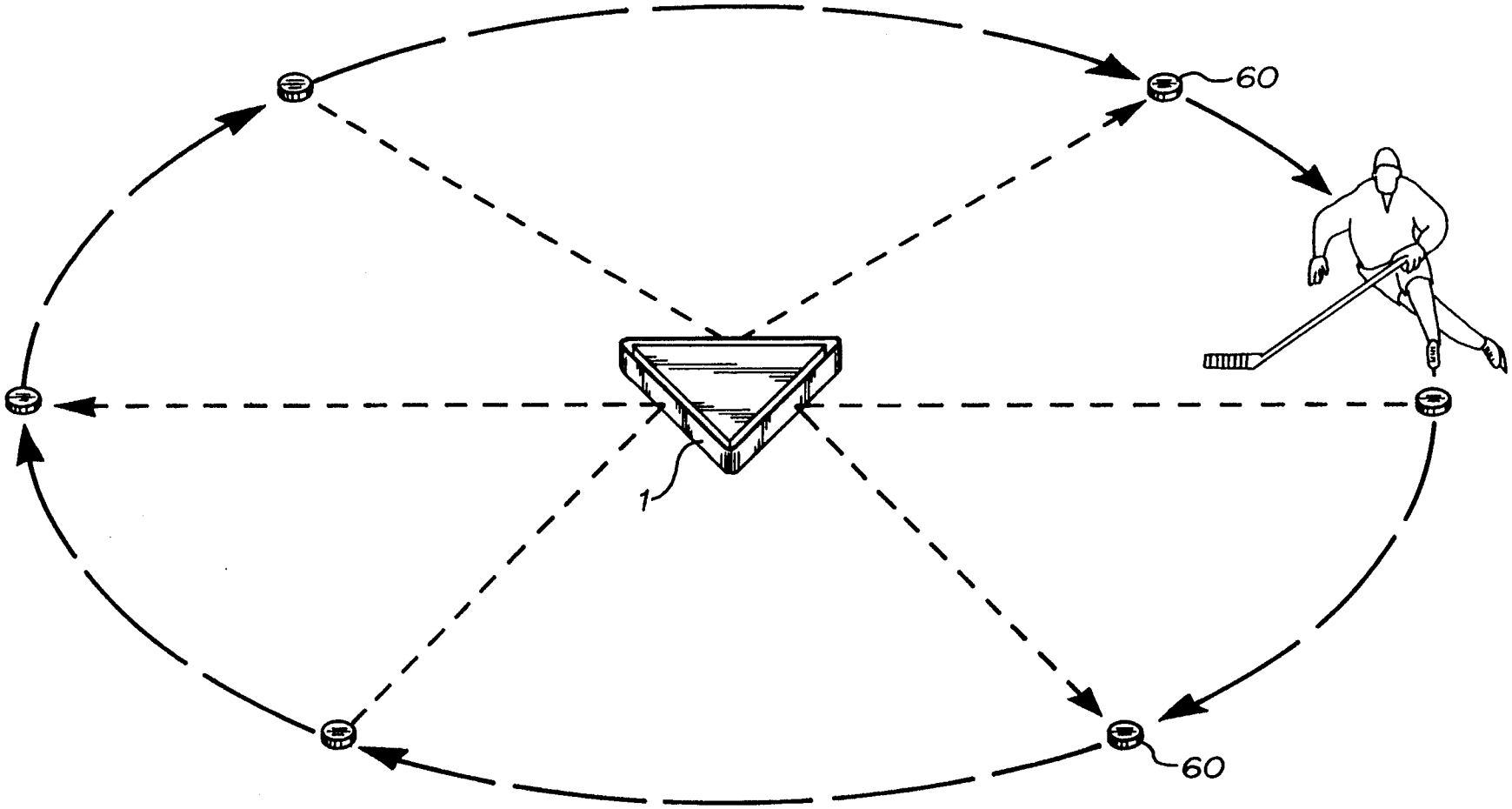
FIG. 21 is a diagrammatic representation of a fourth drill.

The use of device 1 will now be described with reference to FIGS. 18 through 21. FIGS. 18 through 21 illustrated four potential drills which demonstrate the utility of the invention. It will be appreciated by one skilled in the art that there are an infinite variety of drills which can be devised, depending upon the training needs of a team or an individual player. Referring to FIG. 18, device 1 is anchored to the ice even with a hockey net, generally identified by reference numeral 100. The player passes hockey puck 60 to device 1, receives a rebound from device 1 as a return pass and shoots hockey puck 60 into the hockey net 100. Referring to FIG. 19, the player skates down the ice and passes hockey puck 60 to device 1. He continues to skate down the ice and receives a rebound of hockey puck 60 from device 1 as a return pass. By placing more than one of device 1 on the ice surface, the drill can be made continuous around the ice surface. Part of this second drill can include a shot at hockey net 100. Referring to FIG. 20, the player passes hockey puck 60 to device 1 while skating slowly backwards or remaining substantially stationary. He then receives a rebound of hockey puck 60 from device 1 as a return pass. This simulates the actions of a hockey defenseman. The drill can include a shot at hockey net 100. Referring to FIG. 21, the player circles around device 1, making passes of hockey puck 60 to device 1 and receiving rebounds from device 1 as return passes. Alternating directions enables the player to practise passing and receiving passes on both his forehand and his backhand. It will be apparent to one skilled in the art that the described drills help develop a players passing and pass receiving skills while skating. The player is forced to keep his head up, react on the move to the "return pass", and improve the speed and accuracy of his passing. Overall fitness levels can be increased through solo workouts.

It will be understood by persons skilled in the art that various changes may be made in form, materials, details, arrangement and proportions of the parts of the preferred embodiment that has been disclosed and described in detail herein without departing from the spirit and scope of the invention as defined in the claims.

The embodiments of the invention in which an exclusive property or privilege is claimed are defined as follows:

1. A practice device for the game of Hockey, comprising:

a. a body having at least two support members;

b. means for securing the body to an ice surface, such that the at least two support members are immediately adjacent the ice surface; and c. a resilient rebound member extending between the at least two support members, the rebound member being an elongate elastic band placed in tension between the support members, such that the rebound member springs back with a resilient force when struck by a hockey puck thereby increasing the resulting rebound of the hockey puck.

2. A practice device for the game of Hockey as defined in claim 1, the body having three support members in a triangular configuration.

3. A practice device for the game of Hockey as defined in claim 3, the spacing between the support members defining an equilateral triangle.

4. A practice device for the game of Hockey as defined in claim 1, the band being continuous.

5. A practice device for the game of Hockey as defined in claim 1, means being provided to alter the relative spacing between the support members.

6. A practice device for the game of Hockey as defined in claim 5, the means for adjusting the relative spacing of the support members comprising:

a. at least two push rod guides being secured to the body b. at least two push rods received in the push rod guides and axially movable in relative to the push rod guides between extended and retracted positions;

c. each of the supports being attached to one of the push rods, such that as the push rods move axially between the extended and retracted positions the relative spacing of the supports is altered;

d. a movable member attached to the body, the movable member being in communication with the push rods, such that upon movement of the movable member in one direction the push rods are axially extended in relation to the push rod guides, and upon movement of the movable member in a second direction the push rods are axially retracted in relation to the push rod guides; and e. means for moving the movable member.

7. A practice device for the game of Hockey as defined in claim 1, the band being of a cross-section which resists longitudinal torsion.

8. A practice device for the game of Hockey as defined in claim 7, the band having an upper edge, a lower edge, and being inwardly tapered from the upper edge and the lower edge.

9. A practice device for the game of Hockey as defined in claim 1, the band being of a polyolefin material which has an extensive elongation range, and is resistant to compression set, impact and low temperatures.

10. A practice device for the game of Hockey as defined in claim 1, the band being of a polyvinyl chloride material which has an extensive elongation range, and is resistant to compression set, impact and low temperatures.

11. A practice device for the game of Hockey as defined in claim 1, the band being of a thermoplastic rubber material which has an extensive elongation range, and is resistant to compression set, impact and low temperatures.

12. A practice device for the game of Hockey as defined in claim 1, the band being of a urethane material which has an extensive elongation range, and is resistant to compression set, impact and low temperatures.

13. A practice device for the game of Hockey, comprising:

a. a body having three support members arranged in a triangular configuration defining an equilateral triangle;

b. means for securing the body to an ice surface, such that the support members are immediately adjacent the ice surface; and c. a resilient rebound member in the form of a continuous elongate elastic band placed in tension between the support members, such that the rebound member springs back with a resilient force when struck by a hockey puck thereby increasing the resulting rebound of the hockey puck.

14. A practice device for the game of Hockey, comprising:

a. a body;

b. three push rod guides secured to the body, the push rod guides being arranged in a triangular configuration defining an equilateral triangle;

c. push rods received in the push rod guides and axially movable in relative to the push rod guides between extended and retracted positions, a support member being attached to each one of the push rods, such that as the push rods move axially between the extended and retracted positions the relative spacing of the support members is altered;

d. pins extending downwardly from the body whereby the body is secured to an ice surface, such that the support members are immediately adjacent the ice surface; and e. a resilient rebound member in the form of a continuous elongate elastic band placed in tension between the support members, such that the rebound member springs back with a resilient force when struck by a hockey puck thereby increasing the resulting rebound of the hockey puck;

f. a movable member slidably secured to the body, the movable member being in communication with the push rods, such that upon movement of the movable member in one direction the push rods are axially extended in relation to the push rod guides, and upon movement of the movable member in a second direction the push rods are axially retracted in relation to the push rod guides; and g. means for moving the movable member thereby adjusting the relative spacing of the support members.

15. A practice device for the game of Hockey, comprising:

a. a body;

b. three push rod guides secured to the body, the push rod guides being arranged in a triangular configuration defining an equilateral triangle;

c. push rods received in the push rod guides and axially movable in relative to the push rod guides between extended and retracted positions, a support member being attached to each one of the push rods, such that as the push rods move axially between the extended and retracted positions the relative spacing of the support members is altered;

d. pins extending downwardly from the body whereby the body is secured to an ice surface, such that the support members are immediately adjacent the ice surface; and e. a resilient rebound member in the form of a continuous elongate elastic band placed in tension between the support members, such that the rebound member springs back with a resilient force when struck by a hockey puck thereby increasing the resulting rebound of the hockey puck;

f. a movable member mounted for rotation to the body, the movable member being in communication with the push rods, such that upon movement of the movable member in one direction the push rods are axially extended in relation to the push rod guides, and upon movement of the movable member in a second direction the push rods are axially retracted in relation to the push rod guides; and g. means for moving the movable member thereby adjusting the relative spacing of the support members.

16. A practice device for the game of Hockey, comprising:

a. a body;

b. three push rod guides secured to the body, the push rod guides being arranged in a triangular configuration defining an equilateral triangle;

c. push rods received in the push rod guides and axially movable in relative to the push rod guides between extended and retracted positions, a support member being attached to each one of the push rods, such that as the push rods move axially between the extended and retracted positions the relative spacing of the support members is altered;

d. pins extending downwardly from the body whereby the body is secured to an ice surface, such that the support members are immediately adjacent the ice surface; and e. a resilient rebound member in the form of a continuous elongate elastic band placed in tension between the support members, such that the rebound member springs back with a resilient force when struck by a hockey puck thereby increasing the resulting rebound of the hockey puck, the band having an upper edge, a lower edge, and being inwardly tapered from the upper edge and the lower edge;

f. a pair of guide rods secured to the body;

g. a movable member slidably secured to the guide rods, the movable member having two angled side plates which serve as a cam-like surfaces, the side plates on the movable member being in communication with rollers on two of the push rods which serve as followers, such that upon movement of the movable member in one direction the push rods are axially extended in relation to the push rod guides, and upon movement of the movable member in a second direction the push rods are axially retracted in relation to the push rod guides; and h. one of the three push rods having a threaded end which is connected by a turnbuckle to a threaded rod projecting from the movable member, such that upon rotation of the turnbuckle the movable member is moved along the guide rods thereby altering the Positioning of the push rods and adjusting the relative spacing of the support members.

* * * * *